US005534301A

United States Patent [19]

Shutt

[11] Patent Number: 5,534,301

[45] Date of Patent: Jul. 9, 1996

[54] METHOD FOR PRODUCING CELLULOSE INSULATION MATERIALS USING LIQUID FIRE RETARDANT COMPOSITIONS

[75] Inventor: Thomas C. Shutt, Las Vegas, Nev.

[73] Assignee: Echochem International, Inc., Wheat Ridge, Colo.

[21] Appl. No.: 438,378

[22] Filed: May 10, 1995

[51] Int. Cl.[6] ..... B05D 3/02; B05D 3/04

[52] U.S. Cl. ..... 427/377; 106/15.05; 106/18.16; 162/159; 162/181.2; 427/378; 427/427; 428/921

[58] Field of Search ..... 106/15.05, 19.16; 162/159, 181.2; 427/377, 378, 427, 921

[56] References Cited

U.S. PATENT DOCUMENTS

| | | | |
|---|---|---|---|
| 3,761,294 | 9/1973 | Shutt | 106/65 |
| 3,963,506 | 6/1976 | Shutt et al. | 106/67 |
| 4,016,131 | 4/1977 | Shutt et al. | 106/52 X |
| 4,130,538 | 12/1978 | Shutt | 260/40 R |
| 4,168,175 | 9/1979 | Shutt | 106/15.05 |
| 4,224,169 | 9/1980 | Ritana | 162/159 X |
| 4,349,413 | 9/1982 | Ekland | 162/159 X |
| 4,595,414 | 6/1986 | Shutt | 106/18.16 |

*Primary Examiner*—Michael Lusignan
*Attorney, Agent, or Firm*—Klaas, Law, O'Meara & Malkin

[57] ABSTRACT

A method for producing fire-resistant cellulose insulation materials using liquid fire retardants. Cellulose materials (e.g. paper) are initially shredded into multiple pieces which are sprayed with a mist containing liquid fire retardants. The sprayed paper is then subjected to a delay period before further processing to ensure diffusion of the fire retardants into the paper. The paper is then passed into a drying chamber in combination with a stream of heated air. The air is preferably introduced into the chamber in a non-parallel, angular flow path relative to the longitudinal axis of the chamber. To completely dry the paper, movement of the paper and heated air through the chamber is periodically interrupted so that the paper is completely dried by the air. Interruption may be achieved by providing moving baffle members within the chamber. As a result, a dried cellulose insulation product is manufactured.

29 Claims, 3 Drawing Sheets

METHOD FOR PRODUCING CELLULOSE INSULATION MATERIALS USING LIQUID FIRE RETARDANT COMPOSITIONS

BACKGROUND OF THE INVENTION

The present invention generally relates to the production of a fire-resistant cellulose insulation product, and more particularly to the manufacture of fire-resistant cellulose insulation materials using a process which exclusively involves liquid fire retardant compositions.

Cellulose compositions combined with fire retardant materials are widely used in the construction industry. Specifically, fire-resistant cellulose materials are traditionally used for thermal insulation in the walls and attic spaces of homes and commercial buildings. Insulation products of this type are designed to prevent heat loss and correspondingly insulate building structures from the outside environment. Raw materials used to produce cellulose insulation products may involve many different paper compositions ranging from recycled newspaper to cardboard, paperboard, and fiberboard. These materials are physically processed to produce a finely-divided material having a low bulk density.

To achieve an approved level of flame and/or smolder resistance, the selected cellulose materials are combined with fire retardant compositions during the production process. Many different fire retardants may be used for this purpose, which are traditionally applied in powder form. Exemplary fire retardant compositions include but are not limited to monoammonium phosphate, diammonium phosphate, boric acid, aluminum sulfate, ammonium sulfate, sodium tetraborate and mixtures thereof. These materials, as well as other fire retardant compositions and additional information regarding the production of cellulose insulation products are discussed in U.S. Pat. Nos. 4,168,175 to Shutt and 4,595,414 to Shutt which are incorporated herein by reference.

After combining the selected fire retardant compositions and cellulose materials, the resulting product is physically processed using conventional mechanical devices (e.g. hammermill systems known in the art) to produce a pulverized, finely divided insulation product. In accordance with traditional processing technology, fire-resistant cellulose insulation products are specifically prepared using one of two basic methods. In a first method, the selected cellulose materials (e.g. recycled/used paper products) are subjected to multi-stage size reduction by grinding or other conventional processes using standard equipment including but not limited to hammermill systems. At selected stages during the size reduction process, a fire retardant composition in powder (dry) form is combined/mixed with the cellulose materials. In a preferred embodiment, mixing of these ingredients is undertaken at or near the final grinding/shredding stages of the system.

Alternative "hybrid-type" systems have been developed which involve addition of fire retardant compositions in powder (dry) form at or near the final size-reduction stages of the system in combination with the use of a liquid fire retardant composition in the initial stages of production. However, both of these systems require the use of powdered (dry) fire retardant compositions which present numerous disadvantages. These disadvantages include but are not limited to (1) the generation of substantial amounts of dust which requires elaborate safety and environmental control systems; (2) an increased amount of processing machinery which is needed to handle and deliver powdered chemical compositions; (3) the need to use large amounts of chemicals (e.g. fire retardants) due to production inefficiencies associated with powder-type systems; and (4) increased material costs associated with the need to use large quantities of powdered chemicals.

The present invention involves a unique and distinctive all-liquid fire retardant system which entirely avoids the use of any fire retardants in powdered (dry) form. As described below, the claimed system includes a unique combination of process steps which efficiently produce a cellulose insulation product in a highly effective manner while avoiding the problems listed above. Furthermore, the claimed process provides numerous important and substantial advantages not attainable by powder-based systems including but not limited to (1) the substantial elimination of dust problems and the safety considerations/control equipment associated therewith; (2) a reduction in the amount and complexity of processing equipment needed to manufacture the insulation product; (3) a substantial reduction in chemical (e.g. fire retardant) use; and (4) a corresponding reduction in material costs due to decreased chemical use.

In addition to the benefits provided above, the final insulation product manufactured in accordance with the invention readily meets all applicable government requirements and has a lower average bulk density compared with materials produced using powdered fire retardants. The term "bulk density" as used herein shall be defined to encompass the weight (traditionally in lbs./ft$^3$) of the final installed/settled insulation product. A final product with a low bulk density is desired because it imparts less weight to the building structure in which it is used. In addition, it is more free-flowing, easier to handle, and more readily installed. Furthermore, the fiber materials in the completed product have a higher degree of rigidity which results in less settling of the product when used in a building structure compared with conventionally-prepared insulation products. Minimal settling of the insulation product is beneficial because it enables less of the product to be used, thereby providing significant cost savings. Finally, the completed insulation product is characterized by a substantial absence of detached fibrous residue which, if present, can reduce the fire/heat resistance of the final insulation product and increase its density. Accordingly, the present invention represents an advance in the art of cellulose insulation manufacture, and provides many economic, safety, quality-control, and other benefits compared with powder-based systems as discussed below.

SUMMARY OF THE INVENTION

It is an object of the present invention to provide a method for producing a fire-resistant cellulose insulation product which is characterized by a high degree of production efficiency.

It is another object of the invention to provide a method for producing a fire-resistant cellulose insulation product which is readily implemented using a minimal amount of process steps and production machinery.

It is another object of the invention to provide a method for producing a fire-resistant cellulose insulation product which is characterized by a high degree of safety with minimal environmental impact.

It is another object of the invention to provide a method for producing a fire-resistant cellulose insulation product which entirely avoids the use of powdered fire retardant compositions, and instead involves liquid fire retardant materials which are more readily handled without the dust problems encountered when powdered compositions are employed.

It is a further object of the invention to provide a method for producing a fire-resistant cellulose insulation product which is highly economical and characterized by low material costs and operating expenses.

It is a still further object of the invention to provide a method for producing a fire-resistant cellulose insulation product which readily meets all applicable government regulations.

It is an even further object of the invention to provide a method for producing a fire-resistant cellulose insulation product in which the completed product is characterized by a low bulk density and a high degree of fiber rigidity/stability.

In accordance with the foregoing objects, the present invention involves a unique and highly efficient method for producing a fire-resistant cellulose insulation product. The claimed method is characterized by the foregoing benefits which are achieved through the exclusive use of liquid fire retardant compositions, with a total absence of conventional powder-type retardants. To manufacture a fire-resistant cellulose insulation product in an all-liquid system, the present invention is characterized by a combination of unique processing steps which (A) enable the correct amount of liquid fire retardant compositions to be diffused within the selected cellulose materials; and (B) permit complete drying of the cellulose materials while producing minimal amounts of fine fibrous residue (which, if present, can diminish the fire-resistance of the completed product).

A brief summary of the invention will now be provided using broad descriptions and terminology, with specific details of the process being presented below in the Detailed Description of Preferred Embodiments. The claimed process initially involves obtaining and providing a supply of cellulose material. In a preferred embodiment, paper is used as the supply of cellulose material. The term "paper" as used herein shall encompass a wide variety of vegetable or wood-based fiber materials ranging from conventional paper products to cardboard, fiberboard, and the like. Furthermore, the selected paper materials may involve virgin (unused) products or, in a preferred embodiment, recycled paper. An exemplary and preferred product suitable for processing in accordance with the invention involves recycled newspaper (optimally "grade 8" newspaper).

The selected paper materials (e.g. recycled newspaper) are then loaded into one or more conventional shredding and/or grinding systems to produce and provide a plurality of individual pieces of paper which, in a preferred embodiment, have an average width of about 2–6 in. and an average length of about 2–6 in. While these numerical values are preferred for use in the claimed process, the present invention shall not be limited to the foregoing numerical parameters which are provided for example purposes. The precise paper size to be used at this stage of the process may be determined in accordance with preliminary pilot studies on the paper compositions being treated.

The individual pieces of paper are then transferred into a conventional spraying apparatus (e.g. a standard spray booth) in which at least one liquid fire retardant composition is applied to the paper. As a result, a fire retardant-soaked paper product is generated which comprises the initial pieces of paper soaked with the selected liquid fire retardant composition. To ensure proper and complete diffusion of the liquid fire retardant composition within the paper, the liquid fire retardant composition is optimally delivered to the paper materials in the form of a fine mist comprising a plurality of droplets each having a diameter of about 40–200 microns. Using this approach, the selected fire retardant composition can adequately and completely diffuse into the fibrous matrix of the paper.

Solutions of many different fire retardant chemicals may be used in the claimed process, with the present invention not being limited to any particular agents or combinations thereof. For example, aqueous solutions of the following compounds may be used as the liquid fire retardant composition: monoammonium phosphate, diammonium phosphate, boric acid, aluminum sulfate, ammonium sulfate, sodium tetraborate, ferrous sulfate, zinc sulfate, and mixtures thereof. Additional information regarding specific liquid fire retardant compositions and compounds which may used in the present invention is discussed in the Detailed Description of Preferred Embodiments provided below.

The fire retardant-soaked paper product is then transferred into a drying chamber along with a stream of heated air. However, between the application of a selected liquid fire retardant composition to the paper and passage of the fire retardant-soaked paper product into the drying chamber, a given amount of "dwell time" is allowed to lapse. A sufficient amount of dwell time ensures complete diffusion of the liquid fire retardant composition into the interior regions of the paper materials. In a preferred embodiment, a dwell time period of about 45–120 seconds will be allowed to lapse after application of the liquid fire retardant composition to the paper materials, with the exact time period depending on the type of paper being employed and other experimentally-determined factors.

As discussed below, the imposition of dwell time at this stage in the system may be accomplished in many ways, with the present invention not being limited to any particular method. For example, prior to passage of the fire retardant-soaked paper product into the drying chamber, the paper product may be allowed to reside in one or more stationary hoppers or containment vessels for a selected amount of time. Likewise, after production of the fire retardant-soaked paper product, the product may be conveyed to subsequent parts of the processing system using conventional feeding devices (e.g. feed screw mechanisms or the like) which are operated at a controlled rate of speed to impart a delay in delivering the product to subsequent production stages. This procedure may be employed with or without the use of stationary hoppers as described above to provide a sufficient degree of dwell time.

Regarding the paper drying chamber, a stream of heated air is passed into and through the chamber. The stream of heated air is designed to simultaneously move and dry the paper product within the chamber. In a preferred embodiment as discussed below, the drying chamber will be circular in cross-section and tubular in construction with a longitudinal axis therethrough. To achieve optimum results, the stream of heated air will be introduced (delivered) into the drying chamber in an angular, non-parallel orientation relative to the longitudinal axis of the drying chamber. The angle of air introduction will preferably be about 90° relative to the longitudinal axis of the chamber so that the stream of heated air enters the drying chamber in a direction which is perpendicular to the longitudinal axis. However, depending on the particular configuration of the system, the angle of air introduction relative to the longitudinal axis of the drying chamber may range from about 60°–90°, with about 90° again being preferred. It is also preferred that the stream of heated air be introduced in a manner wherein the stream is laterally offset from (e.g. to the side of) the longitudinal axis of the drying chamber. As a result, the stream of heated air entering the chamber will travel in a substantially helical pathway around and along the circular interior surface of the chamber which slows the movement of materials passing through the chamber as discussed below. In a preferred embodiment, the stream of heated air is introduced into the chamber at a flow rate of about 2500–3500 ft./min. (which may be varied as necessary in accordance with preliminary pilot studies on the materials being processed).

The fire retardant-soaked paper product is then passed into and through the drying chamber in combination with the stream of heated air after completion of the dwell time period listed above. As previously noted, the stream of heated air is designed to simultaneously move the paper product through the drying chamber and completely dry the paper product within the chamber. However, to properly implement the all-liquid fire retardant system of the present invention, an additional amount of dwell time must be imparted to the paper product within the drying chamber to ensure that the paper product is completely dried. If the paper product is allowed to flow through the drying chamber with the stream of heated air in an uninterrupted manner, the paper product will not be completely dry upon leaving the chamber. As a result, the final insulation product will contain a substantial amount of fibrous residue which can diminish the fire/heat resistance of the product. Although introduction of the heated air in a helical flow path causes the paper product to pass through the chamber at a slower rate (compared with a linear flow path), additional dwell time is needed to ensure complete drying. To completely dry the paper product, the claimed process involves the inventive step of temporarily interrupting passage of the fire retardant-soaked paper product and heated air through the drying chamber periodically (e.g. at least once and preferably multiple times) during movement of these components within the drying chamber. This step slows the flow of the paper product and air through the drying chamber as discussed in further detail below which enables greater contact between the heated air and paper product. Since interruption of these components is temporary and periodic as indicated above, once the paper product and air begin moving again after being interrupted, the stream of air accelerates faster than the paper product. This occurs because the air is lighter and less dense than the paper product. As a result, the stream of heated air flows over the surface of the slower-moving paper product causing more intimate contact and increased drying of the paper product. In this regard, the more interruptions of the foregoing components, the greater the drying capacity of the system. Without temporarily and periodically interrupting (e.g. slowing) the foregoing components as they move through the drying chamber, an inadequately-dried material would be generated, thereby causing the problems listed above. As a result of the above-described process, a dried fire-resistant cellulose insulation product is generated within the drying chamber.

There are numerous ways to temporarily and periodically interrupt the fire retardant-soaked paper product and the stream of heated air as they pass through the drying chamber. Accordingly, the present invention shall not be limited to any particular method or apparatus for this purpose. In a preferred embodiment, temporary interruption of the paper product and air as they flow through the drying chamber may be accomplished through the use of a chamber which includes one or more stationary or movable baffle members therein. In a preferred embodiment, the baffle members are movable (e.g. rotatable), and are continuously moved within the drying chamber during passage of the heated air and paper product therethrough. As a result, the paper product passing through the chamber comes in contact with (e.g. physically engages) at least one and preferably multiple baffle members during movement of the baffle members within the chamber. Engagement of the paper product with the baffle members temporarily interrupts the transportation and flow of the paper product through the drying chamber. The same situation occurs regarding the stream of heated air as it moves through the drying chamber. As a result, passage of the paper product through the chamber is substantially delayed (compared with a chamber which lacks any baffle members therein). While a delay also occurs regarding the stream of air as it encounters the baffle members and moves through the chamber, this delay is less compared with the paper product due to the lighter weight of the air within the system. This process in which the paper product experiences a greater degree of delay or "dwell time" within the chamber compared with the stream of heated air enables a more continuous and sustained level of air flow over and in contact with the paper product. As a result, the paper product is completely dried so that a fire-resistant cellulose insulation product can be produced within the drying chamber.

Regardless of which method is used to delay the movement of materials through the drying chamber, the fire-resistant cellulose insulation product is ultimately collected from the chamber and further processed as desired to achieve additional size reduction. Size reduction may be accomplished using one or more hammermill units or other comparable systems known in the art for this purpose. The completed insulation product is then packaged (e.g. bagged) and sold.

As previously indicated, the all-liquid process of the present invention provides numerous advantages compared with prior systems which employ powdered (dry) fire retardants. In this regard, the present invention represents a significant advance in the art of cellulose insulation manufacture as discussed below.

BRIEF DESCRIPTION OF THE DRAWINGS

Illustrative and presently preferred embodiments of the present invention are illustrated and shown in the following drawing Figures.

DETAILED DESCRIPTION OF PREFERRED EMBODIMENTS

The present invention involves a unique and highly efficient method for producing a cellulose (e.g. paper-based) insulation product which avoids the use of powdered (dry) fire retardant compositions. Instead, the claimed process involves an allliquid system which avoids the disadvantages associated with powder-type processes. These disadvantages include but are not limited to (1) the generation of substantial amounts of dust which requires elaborate safety and environmental control systems; (2) an increased amount of processing machinery which is needed to handle and deliver powdered chemical compositions; (3) the need to use greater amounts of chemicals (e.g. fire retardants) due to production inefficiencies associated with powder-type systems; and (4) increased material costs associated with the need to use large quantities of powdered chemicals. Accordingly, the claimed process provides numerous important advantages not attainable by powder-based systems including but not limited to (A) the substantial elimination of dust problems and the safety considerations/control equipment associated therewith; (B) a reduction in the amount and complexity of processing equipment needed to manufacture the insulation product; (C) a substantial reduction in chemical (e.g. fire retardant) use; and (D) a corresponding reduction in material costs due to decreased chemical use. Furthermore, the final product produced using the claimed process meets all applicable government requirements for fire resistance, and has a lower bulk density compared with materials produced using powdered fire retardants. The term "bulk density" and the importance of producing an insulation product having a low bulk density are discussed above. In addition, the insulation product produced in accordance with the invention is characterized by a substantial absence of fine detached fibrous residue which (if present) can reduce the fire/heat resistance of the product. Finally, the fiber materials in the completed product are more rigid compared with insulation materials produced in a conventional manner. This characteristic results in less settling of the product when used in building structures as discussed above. All of these benefits are achieved in a manner which is more economical compared with powder-type systems. Accordingly, the present invention represents a significant advance in the art of cellulose insulation manufacture as discussed below.

Figure 1:
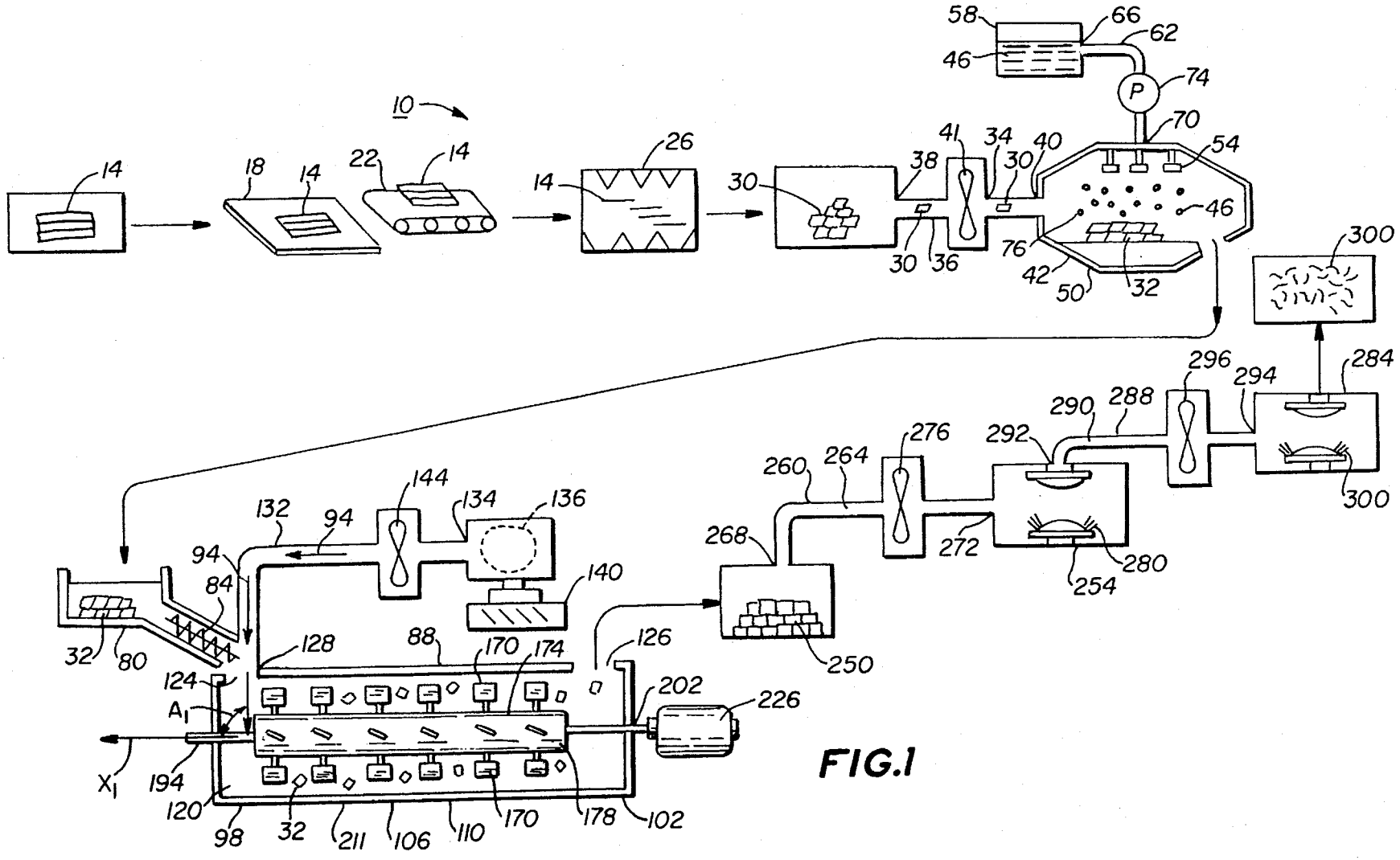
FIG. 1 is a schematic illustration of the process steps, materials, and procedures associated with the production of a fire-resistant cellulose insulation product in accordance with a preferred embodiment of the invention.

FIG. 1 involves a schematic illustration of the process steps and equipment which are used in accordance with a preferred embodiment of the invention. With reference to FIG. 1, an exemplary processing system is provided which is represented at reference number 10. To produce a completed, fire-resistant cellulose insulation product in accordance with the invention, a supply of cellulose material 14 is initially provided. The cellulose material 14 will basically involve vegetable fiber materials, wood fiber compositions, or any other cellulosic substrates which are known in the art for producing insulation materials. Preferably, the supply of cellulose material 14 will consist of virgin (unused) or recycled (used) paper, with the term "paper" encompassing commercial products derived from wood or other plant materials ranging from newspaper to cardboard, fiberboard, and paperboard. However, the present invention shall not be limited to any particular paper or cellulose compositions, with a variety of different materials being suitable for use in the system 10. An exemplary and preferred product which may be employed as the supply of cellulose material 14 involves recycled (used) newspaper (preferably "grade 8") having a thickness of about 0.0031–0.0037 in. This material is preferred because it is readily handled, is easy to grind, and produces less dust than other paper products. Also, the term "grade 8" involves a standard purity designation regarding the paper product (e.g. that it contains all newspaper with virtually no cardboard or other dissimilar paper materials).

Once the supply of cellulose material 14 has been selected, it is placed on a feed table 18 or other comparable platform-type structure where the material 14 can be manually sorted and separated (if necessary) from non-cellulose materials and other undesirable compositions. Next, the supply of cellulose material 14 (e.g. grade 8 newspaper) is routed via a standard conveyor belt system 22 or other conventional transport unit into a shredding apparatus 26 which is schematically illustrated in FIG. 1. The shredding apparatus 26 may involve many different types of standard systems, and the present invention shall not be limited to any particular system for this purpose. However, the selected shredding apparatus 26 should be capable of receiving and processing the supply of cellulose material 14 at a rate of about 7000–9000 lbs./hour. In a preferred embodiment, the shredding apparatus 26 will consist of a metal cylinder with an entrance port and an exit port. Mounted on the interior surface of the side wall associated with the cylinder are a plurality of metal teeth. A rotating shaft runs through the cylinder and turns at about 1300–1500 rpm. The shaft likewise includes a plurality of teeth thereon. Engagement of the cellulose material 14 with the teeth on the shaft and inside the cylinder causes the material 14 to be shredded in a highly efficient manner. An exemplary shredding apparatus 26 of this type is commercially available from Jacobsen Machine Works of Minneapolis, Minn. (U.S.A.). In a preferred embodiment, the foregoing shredding apparatus 26 will be powered by a 100–150 H.P. electric motor.

With continued reference to FIG. 1, the shredding apparatus 26 will receive the incoming supply of cellulose material 14 and physically reduce the size of the material 14 to a desired level. While the present invention shall not be limited to any particular type of cellulose material 14 as indicated above, the remaining discussion of the invention shall refer to the use of paper products within the system 10, with the term "paper" being defined above. In this regard, the paper products (e.g. grade 8 newspaper) which are used as the cellulose material 14 will be processed by the shredding apparatus 26 to produce and provide a plurality of individual pieces of paper 30 which are schematically shown in FIG. 1. The pieces of paper 30 may be sized as desired by suitable adjustment of the shredding apparatus 26 in accordance with preliminary pilot studies on the materials of interest. However, in a preferred and optimum embodiment, each of the individual pieces of paper 30 will have a length of about 2–6 in. and a width of about 2–6 in. Size reduction using the shredding apparatus 26 is desired so that the selected paper materials are more readily handled and transported through subsequent stages of the system 10.

The pieces of paper 30 are then routed from the shredding apparatus 26 into a first air transport system 34 of standard design which uses a flow of air (e.g. at a preferred flow rate/velocity of about 3000–6000 ft./min.) to move the pieces of paper 30 to the next stage in the system 10. In a preferred embodiment, the air transport system 34 will consist of a conduit 36 having a first end 38 which is operatively connected to the shredding apparatus 26 for receiving the pieces of paper 30, and a second end 40. Positioned in-line within the conduit 36 between the first end 38 and the second end 40 is a motor driven fan unit 41. The fan unit 41 is oriented so that it draws the pieces of paper 30 by suction into and through the conduit 36, directly through the fan unit 41, and into subsequent stages of the system 10. The fan unit 41 is sized to permit passage of the pieces of paper 30 therethrough without significant damage or shredding of the paper 30. In a preferred embodiment, the fan unit 41 is designed to operate at a speed of about 1800–2200 rpm with a blade having a diameter of about 22 inches so that sufficient suction forces are generated within the conduit 36. Air transport systems of the type described above are known in the art for material transfer, and are commercially available from W. W. Grainger Company in Las Vegas, Nev.

(U.S.A.)—model number 3C108. However, the present invention shall not be limited to this type of air transport system, with other air transport systems of comparable design also being suitable for use within the system 10.

The first air transport system 34 is used to deliver (e.g. blow) the pieces of paper 30 into a spraying system 42. The spraying system 42 is designed to deliver at least one liquid fire retardant composition 46 to the pieces of paper 30. Many different spraying devices may be used in connection with the spraying system 42, with the present invention not being limited to any particular apparatus for this purpose. In a preferred embodiment, the spraying system 42 will consist of a conventional spray booth 50 manufactured of a relatively inert material (e.g. stainless steel or polyethylene plastic). To produce a final insulation product (described below) which contains a proper amount of fire retardant composition diffused entirely therethrough, the spray booth 50 will optimally include one or more spraying nozzles 54 positioned therein which are in fluid communication with a tank 58 containing the selected liquid fire retardant composition 46. The tank 58 is connected to the spray booth 50 and nozzles 54 using a tubular conduit 62 having a first end 66 and a second end 70. The first end 66 is operatively connected to the tank 58, with the second end 70 being operatively connected to the spray booth 50 and nozzles 54 as schematically shown in FIG. 1. Positioned in-line within the conduit 62 is a pump 74 (e.g. of conventional design including but not limited to high pressure, centrifugal, positive displacement, or other types known in the art for fluid transfer). The pump 74 is used to transfer the liquid fire retardant composition 46 under pressure to the spray booth 50 and nozzles 54. In a preferred embodiment, the liquid fire retardant composition 46 (discussed in further detail below) will be supplied to the spray booth 50/nozzles 54 at a pressure of about 40–200 psi so that the liquid fire retardant composition 46 is delivered in the form of a fine mist comprised of a plurality of individual droplets 76 each having a diameter of about 40–200 microns. Accordingly, about 100–300 gallons/hr. of the liquid fire retardant composition 46 is typically delivered to the pieces of paper 30 when processing about 7000–9000 lbs. of paper 30 per hour as noted above.

While the present invention shall not be limited regarding the number and type of nozzles 54 to be used, an exemplary embodiment of the invention will involve introduction of the liquid fire retardant composition 46 using about 8 spray nozzles 54 (e.g. produced by Spraying Systems, Inc. of Chicago, Ill. (U.S.A.)—model designation ¼ LN14) which deliver the composition 46 at a fluid pressure within the foregoing range. Furthermore, each of the nozzles 54 is preferably positioned at a distance of about 12–24 in. from the pieces of paper 30 within the spray booth 50. In addition to high-pressure introduction of the liquid fire retardant composition 46 as discussed above, it shall be deemed equivalent to introduce the liquid fire retardant composition 46 in combination with air through nozzles 54 so that the composition 46 is effectively atomized. Regardless of which method is used, spraying of the liquid fire retardant composition 46 in a fine mist provides many benefits including but not limited to (1) a reduction in the amount of liquid fire retardant composition 46 which is needed; (2) greater dispersion of the composition 46 within the internal fibrous matrix of the paper 30; and (3) a lack of chemical fire retardant dust in the final product as discussed below. Within the spraying system 42 (e.g. spray booth 50), the pieces of paper 30 are converted into a fire retardant-soaked paper product 32. The paper product 32 comprises the initial pieces of paper 30 soaked with the liquid fire retardant composition 46.

Regarding the specific type of liquid fire retardant composition 46 to be used, the present invention shall not be limited to any particular materials in this regard. Accordingly, any liquid-soluble fire retardant chemical may be used which is capable of imparting fire resistance to the selected cellulose materials. For example, a variety of fire retardant compounds which may be used in solution form as the liquid fire retardant composition 46 are listed in U.S. Pat. Nos. 4,595,414 to Shutt and 4,168,175 to Shutt which are incorporated herein by reference. The selected fire retardant composition 46 will typically be formulated as an aqueous solution preferably having about 35–42% by weight total fire retardant dissolved therein. This percentage figure will involve a single fire retardant compound or multiple fire retardant compounds in combination. If multiple compounds are used, the foregoing percentage range will encompass the total amount of combined fire retardant compounds within the prepared solution. In accordance with the parameters and percentages listed above (e.g. involving liquid delivery rates, % by weight composition values, and the like), application of the liquid fire retardant composition 46 will typically produce a fire retardant-soaked paper product 32 which (prior to drying) will contain about 12.5–25% by weight fire retardant composition 46. Upon drying, the completed insulation product will typically contain about 5–10% by weight of the selected fire retardant compound or combined compounds which were previously applied in solution form. In an exemplary embodiment designed to produce 250 bags of the completed insulation product (with each bag weighing about 35 lbs.), about 460–975 lbs. of the selected fire retardant compound or compounds would be combined with water to form a 40% by weight solution. About 1150–2440 lbs. of the solution would then be sprayed as previously described to manufacture the insulation product. However, the present invention shall not be limited to the foregoing example and numerical parameters which may be varied in accordance with preliminary pilot studies.

Exemplary fire retardant compounds suitable for use in solution form are listed in U.S. Pat. Nos. 4,595,414 and 4,168,175 which are incorporated by reference for all that they disclose. The materials listed in these patents (as well as other compositions not listed in the above patents which may be employed) are as follows: ammonium sulfate, monoammonium phosphate, diammonium phosphate, boric acid, aluminum sulfate, sodium tetraborate, ferrous sulfate, zinc sulfate, and mixtures thereof. Preferred fire retardant materials/mixtures from the foregoing list will include the following: (A) ammonium sulfate (alone); (B) a mixture of ammonium sulfate (about 93.7% by weight) and boric acid (about 6.3% by weight); and (C) a mixture of monoammonium phosphate (about 40% by weight) and diammonium phosphate (about 60% by weight). These materials are ultimately combined with water to produce aqueous solutions in accordance with the operational concentration ranges listed above. However, the present invention is not dependent on any specific materials used to produce the liquid fire retardant composition 46 as noted above.

In addition, the liquid fire retardant composition 46 may include a plurality of optional additives which perform a variety of functions. For example, at least one soluble wetting agent may be used to facilitate complete diffusion of the liquid fire retardant composition 46 into the pieces of paper 30 within the spraying system 42. Many different wetting agents may be employed for this purpose, and the present invention shall not be limited to any particular wetting agent or composition. An exemplary product suitable for use as a wetting agent is commercially available from Van Waters and Rodgers Company of Las Vegas, Nev. (U.S.A.) under the name "Bio-Terge Pas 85". From a chemical standpoint, this composition consists of a primary alkane sulfonate. Regardless of which wetting agent is selected, it is preferred that the wetting agent (if used) be added to the liquid fire retardant composition 46 so that the composition 46 is about 0.05–0.1% by weight wetting agent. An exact determination regarding the type and amount of wetting agent to be used, as well as the general need for a wetting agent will be based on preliminary tests involving the particular cellulose material 14 selected for processing in the system 10.

With reference to FIG. 1, the next step in the system 10 involves drying the fire retardant-soaked paper product 32 in a highly efficient and complete manner. However, after application of the liquid fire retardant composition 46 to the pieces of paper 30 and prior to placement of the paper product 32 in a suitable drying chamber, a specific dwell (delay) time period is allowed to lapse. As a result, the liquid fire retardant composition 46 is able to properly and completely diffuse into the pieces of paper 30. To achieve optimum results, the dwell time period will take place between (1) applying of the liquid fire retardant composition 46 to the pieces of paper 30; and (2) placement of the fire retardant-soaked paper product 32 into a selected drying chamber (discussed below). If a sufficient amount of dwell time is not allowed to pass, greater amounts of liquid fire retardant composition 46 must be used to achieve the necessary fire resistance in the final product.

Regarding the amount of dwell time to be used, the selected time period will depend on a wide variety of experimentally-determined factors involving the type of cellulose material 14 being processed and the chemical nature of the fire retardant composition 46. However, in a preferred embodiment, the selected dwell time at this stage in the system 10 will be about 45–120 seconds which is sufficient for most paper products and fire retardant materials. Many different methods may be used to delay transfer of the fire retardant-soaked paper product 32 into subsequent portions of the system 10, and the present invention shall not be limited to any particular procedures for imparting dwell time. For example, dwell time may be provided by transferring the paper product 32 into one or more bins or hoppers for a selected time interval prior to further treatment of the paper product 32. In addition to or instead of using bins/hoppers for this purpose, the paper product 32 may be conveyed into subsequent stages of the system 10 using various transfer systems (e.g. conventional feed screws, conveyor belts, and the like) which are operated at a selected speed in order to cause an in-transit delay in moving the product 32 through the system 10. An exemplary arrangement of components which can be used to impart a desired amount of dwell time at this point in the system 10 is illustrated schematically in FIG. 1.

With reference to FIG. 1, the fire retardant-soaked paper product 32 is gravity fed from the spray booth 50 into a conventional hopper 80 (e.g. made of stainless steel or other inert composition). Within the hopper 80, the paper product 32 is allowed to dwell or reside for a selected time period (e.g. about 60 seconds in an exemplary embodiment). Thereafter, a conventional motor-driven feed screw apparatus 84 is activated which slowly draws the paper product 32 into a paper drying chamber 88 (discussed in greater detail below). In an optimum and preferred embodiment, the feed screw apparatus 84 is about 12 ft. long with a diameter of about 2 ft., and is operated so that it rotates at about 4–6 rpm. Use of the feed screw apparatus 84 as described above imparts an additional dwell time of about 15–30 seconds at this stage in the system 10. Upon delivery of the paper product 32 into the drying chamber 88 using the steps described above, the paper product 32 will have the liquid fire retardant composition 46 completely diffused therein.

Figure 2:
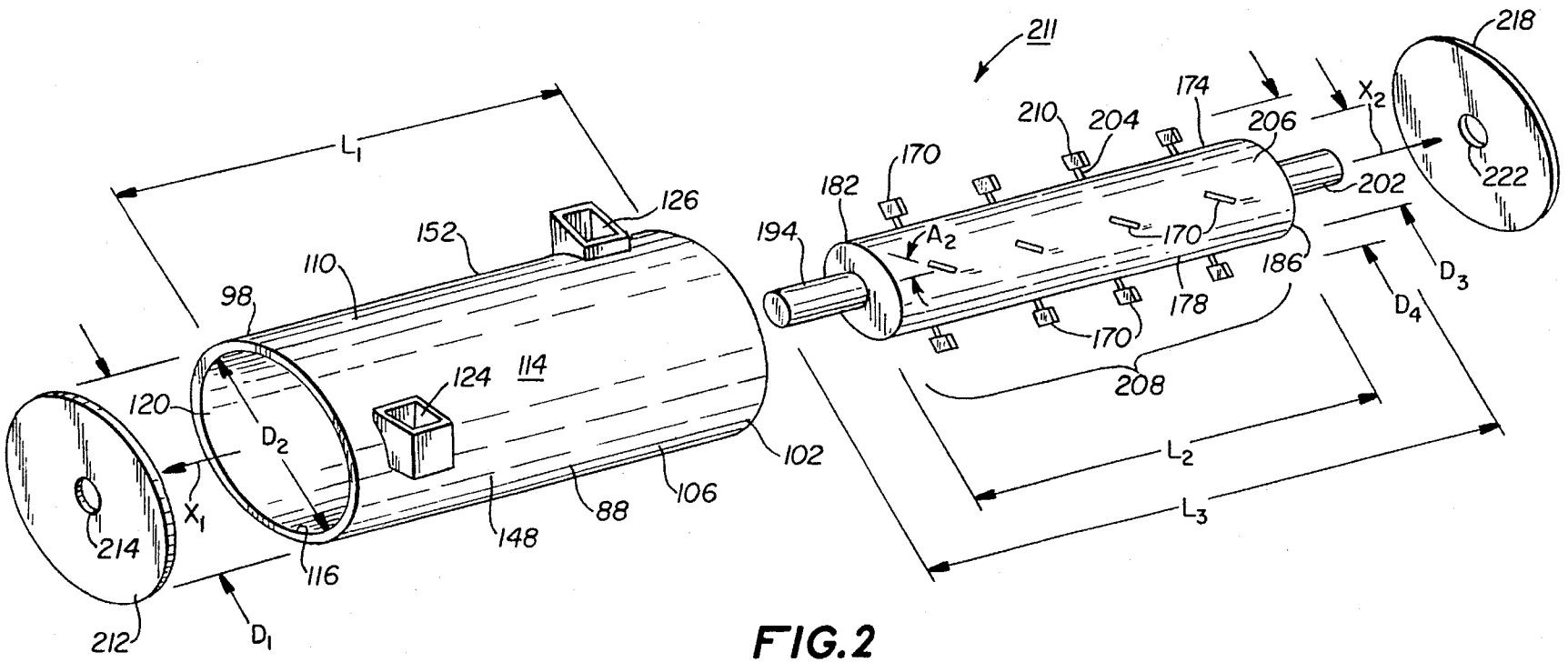
FIG. 2 is a schematic, partially-exploded perspective view of an exemplary drying chamber and associated baffle system used to produce a fire-resistant cellulose insulation product in accordance with the invention.
Figure 3:
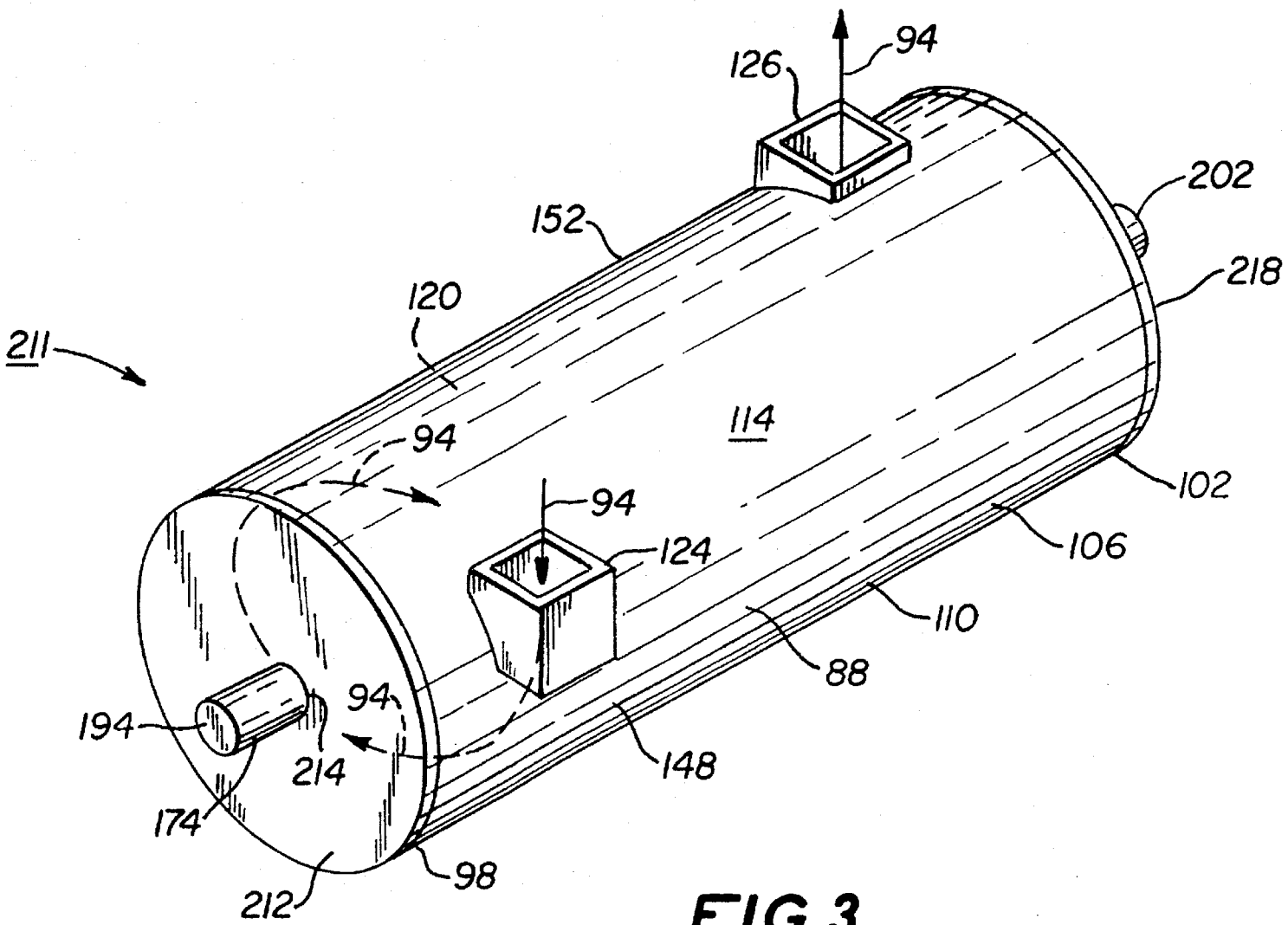
FIG. 3 is a schematic enlarged perspective view of the drying chamber of FIG. 2 in an assembled configuration.

At this point in the system 10, the fire retardant-soaked paper product 32 enters the drying chamber 88. However, prior to or simultaneously with the entry of paper product 32 into the drying chamber 88, a stream of heated air (designated schematically by arrows 94 in FIGS. 1 and 3) is passed into and through the drying chamber 88. In a preferred embodiment, the drying chamber 88 is circular in cross-section and tubular in design. As illustrated in FIGS. 1–3 (with FIG. 1 involving a schematic, cross-sectional view), the drying chamber 88 includes a first end 98, a second end 102, and a medial portion 106 therebetween. Also included is a continuous side wall 110 having a circular exterior surface 114 (FIGS. 2–3), a circular interior surface 116 (FIG. 2), and an interior region 120 therein entirely surrounded by the side wall 110. The drying chamber 88 further includes a central longitudinal axis $X_1$ (FIG. 2) passing therethrough (discussed below).

Positioned adjacent the first end 98 of the drying chamber 88 as shown is an inlet port 124 through the side wall 110. Located adjacent the second end 102 is an outlet port 126. Operatively connected to the inlet port 124 of the chamber 88 (FIG. 1) is the first end 128 of an air flow conduit 132. The second end 134 of the air flow conduit 132 is operatively connected to a supply of air 136 which is heated using a conventional burner system 140. In a preferred embodiment, the burner system 140 will consist of a gas-fired burner apparatus manufactured by the Eclipse Combustion Company of Rockford, Ill. (U.S.A.), although other burner systems involving different designs may be used for this purpose. The burner system 140 will typically have at least about a 2 million BTU capacity with the ability to heat the supply of air 136 so that the stream of heated air 94 entering the chamber 88 will have a temperature of about 300°–350° F. Positioned in-line within the conduit 132 as schematically illustrated in FIG. 1 is at least one conventional motor-driven, fan-type blower unit 144 which is used to direct the stream of heated air 94 through the conduit 132 and into the inlet port 124 of the drying chamber 88. In a preferred embodiment, the stream of heated air 94 will be delivered into the inlet port 124 of the drying chamber 88 in an amount equal to about 5000–8000 $ft^3$/min. at a velocity of about 2500–3500 ft./min. However, these values may be varied, depending on the particular size of the system 10 being employed, as well as other factors.

While many different designs (e.g. non-circular cross-sectional configurations) may be used to construct the drying chamber 88, it is preferred that the drying chamber 88 be circular in cross-section and tubular as shown in FIGS. 2–3. In an exemplary and non-limiting embodiment, the drying chamber 88 will be constructed of an inert and rigid material (e.g. stainless steel or polyethylene), with an average total length $L_1$ (FIG. 2) of about 6–8 ft. and an average external diameter $D_1$ (FIG. 2) of about 5–6 ft. The side wall 110 will have an average thickness of about 0.05–0.25 in. The internal diameter $D_2$ (FIG. 2) of the chamber 88 will vary, and may be determined in any given situation by subtracting the selected thickness values associated with the side wall 110 from the external diameter $D_1$ of the chamber 88. Various functional benefits are provided by the circular internal and external configuration of the drying chamber 88 as discussed below.

To achieve efficient and complete drying of the fire retardant-soaked paper product 32 within the circular/tubular drying chamber 88, it is preferred that the stream of heated air 94 enter the drying chamber 88 in a direction (e.g. flow path) which is non-parallel and at an angle to the longitudinal axis $X_1$ of the drying chamber 88. This angle is designated as $A_1$ in FIG. 1. Angle $A_1$ will preferably be about 90° as illustrated so that the stream of heated air 94 enters the drying chamber 88 in a direction which is perpendicular to the longitudinal axis $X_1$ of the chamber 88. However, depending on the particular configuration of the system 10, the angle $A_1$ may range from about 60°–90°, with about 90° being optimal. In addition, it is preferred that the inlet port 124 in the side wall 110 of the drying chamber 88 be positioned so that it is laterally offset from (e.g. to the side of) longitudinal axis $X_1$ as illustrated in FIG. 2. In the embodiment of FIG. 2, the inlet port 124 is positioned at or near side 148 of the drying chamber 88 so that the inlet port 124 is spaced outwardly from the longitudinal axis $X_1$ as shown. Alternatively, the inlet port 124 could be positioned at or near the opposite side 152 of the drying chamber 88 to achieve substantially equivalent results.

The angular relationship between the longitudinal axis $X_1$ and the stream of heated air 94, as well as the laterally offset configuration of the inlet port 124 in the drying chamber 88 enable the stream of heated air 94 to enter the chamber 88 and immediately come in contact with the interior surface 116 of the side wall 110. As a result, the stream of heated air 94 will travel in a helical pathway along the interior surface 116 of the side wall 110 as schematically shown in FIG. 3. The air 94 within the helical pathway will travel in a clockwise or counterclockwise direction inside the chamber 88, depending on the specific orientation of the inlet port 124 and outlet port 126. In an embodiment in which the inlet port 124 is positioned at side 148 of the chamber 88 and the outlet port 126 is located at side 152, the air 94 will flow in a clockwise direction. However, the air 94 will flow in a counterclockwise direction if the inlet port 124 is positioned at side 152 of the chamber 88, with the outlet port 126 being located at side 148. Substantially equivalent results will be achieved regardless of whether the air 94 flows in a clockwise or counterclockwise direction.

The use of a helical air pathway provides numerous benefits. Compared with a situation in which the stream of heated air 94 is delivered to the chamber 88 in a flow path parallel to the longitudinal axis $X_1$, the helical pathway shown in FIG. 3 increases the dwell or passage time of the air 94 (and entrained paper product 32 as discussed below) within the chamber 88. As a result, the air 94 and paper product 32 will take longer to pass through the chamber 88, thereby permitting sustained contact between these components so that the paper product 32 can be completely dried. It is very important that the paper product 32 be entirely dry upon leaving the chamber 88 for the reasons previously discussed and further described below.

With continued reference to FIGS. 2–3, the drying chamber 88 further includes an outlet port 126 adjacent the second end 102 of the chamber 88 as previously discussed. In a preferred embodiment, the outlet port 126 will be positioned at or near the opposite side 152 of the chamber 88 so that it is laterally offset from (e.g. to the side of) longitudinal axis $X_1$. The stream of heated air 94 and entrained paper product 32 will pass through the outlet port 126 as they leave the drying chamber 88. If, in an alternative embodiment, the inlet port 124 is located at side 152 of the chamber 88 instead of at side 148, the outlet port 126 would be positioned at side 148 without loss of system effectiveness. Regardless of which embodiment is selected, it is preferred that the inlet port 124 and outlet port 126 be positioned at opposite sides of the drying chamber 88.

During the passage of heated air 94 into the drying chamber 88, the fire retardant-soaked paper product 32 is passed into the inlet port 124 of the drying chamber 88 using the screw apparatus 84. As a result, the paper product 32 enters the drying chamber 88 in combination with the stream of heated air 94, with the air 94 moving the paper product 32 through the drying chamber 88. The paper product 32 may be introduced simultaneously with or immediately after initiation of the flow of heated air 94 into the chamber 88. In a preferred embodiment, the paper product 32 enters the drying chamber 88 at a feed rate of about 8150–11440 lbs. of paper product 32 per hour, although the present invention shall not be limited to this rate which is provided for example purposes.

As the paper product 32 moves through the drying chamber 88 with the stream of heated air 94 in a helical flow path, the paper product 32 is dried. However, it is important that a sufficient amount of dwell (delay) time be imparted to the paper product 32 as it flows through the chamber 88 so that complete drying is achieved. While a significant amount of delay time is provided by the helical flow path of the heated air 94 and paper product 32 as previously discussed, it is important that additional delay time be provided to ensure complete drying. If the paper product 32 is not completely dry when it leaves the chamber 88, the final insulation product will include a large amount of fine fibrous residue which can decrease the fire resistance of the completed product. This residue results because the dried paper product is subsequently processed (in a preferred embodiment) within hammermill units which typically generate significant amounts of fibrous residue when insufficiently-dried materials are used. Other problems associated with insufficient drying include increased bulk density levels (discussed above) and larger amounts of dust which are produced during use of the final product. To ensure that the all-liquid system 10 functions in a most effective manner, complete drying of the paper product 32 within the chamber 88 must be accomplished.

To completely dry the fire retardant-soaked paper product 32, the claimed process involves the inventive step of temporarily interrupting the passage of paper product 32 and heated air 94 as they move through the drying chamber 88. Interruption will be undertaken periodically (e.g. at least once and preferably multiple times) during movement of the foregoing materials through the chamber 88. This step causes a considerable delay in the movement of paper product 32 within the drying chamber 88 which enables the product 32 to be completely dried. Because interruption of these components is temporary and periodic (e.g. at selected intervals), once the paper product 32 and air 94 begin moving again after being interrupted, the stream of air 94 accelerates faster than the product 32. This occurs because the air 94 is lighter and less dense than the paper product 32. As a result, the stream of air 94 flows over the surface of the slower-moving paper product 32, causing more intimate contact and increased drying of the product 32. The more interruptions of the paper product 32 and air 94, the greater the drying capacity of the system 10. If the foregoing components were not interrupted as they moved through the chamber 88, an inadequately-dried material would be generated.

There are many ways to periodically interrupt the flow path of the paper product 32 and air 94, with the present invention not being limited to any particular interruption method. As described above, both the paper product 32 and air 94 are periodically interrupted as they flow through the chamber 88. Even though the flow paths of both materials are interrupted, the paper product 32 will ultimately pass through the chamber 88 at a slower rate than the air 94 due to significant weight/density differences between these materials as previously discussed. After interruption, the air 94 (being lighter) is more readily able to accelerate and continue moving compared with the paper product 32 which will have greater residence time within the chamber 88. As a result, a greater amount of air 94 will be able to flow over and come in contact with the paper product 32 in a given time period as the air 94 continues to enter and pass through the chamber 88 while the paper product 32 lags behind. In mathematical terms, this process involves a situation in which the average velocity of each piece of paper associated with the paper product 32 ($V_{ap}$) is less than the average velocity of each air molecule in the stream of heated air 94 ($V_{aa}$). This result occurs because of weight and density differences between the air 94 and paper product 32. The average velocity associated with these items is based on the total distance (D) traveled by each air molecule or piece of paper within the drying chamber 88 (which, in a preferred embodiment, is circular in cross-section to produce a helical flow path). In the embodiment of FIGS. 1–3, D will involve the helical distance travelled by a given air molecule or piece of paper within the chamber 88, with D being constant for both items.

The following mathematical relationships summarize the effect of periodically interrupting the paper product 32 and air 94 as they flow through the drying chamber 88:

| | | |
|---|---|---|
| (1) | $V_{ap} = D/T_1$; | [wherein $T_1$ = total travel time needed for a given piece of paper to move a given distance D within the chamber 88]; |
| (2) | $V_{aa} = D/T_2$; | [wherein $T_2$ = total travel time needed for a given air molecule to move distance D within the chamber 88]; and |
| (3) | $V_{ap} < V_{aa}$ | |

By periodically interrupting the flow of paper product 32 as indicated above, the average velocity $V_{ap}$ of the paper product 32 will be less than the average velocity $V_{aa}$ of the heated air 94 within the chamber 88. Even though the air 94 and the paper product 32 are both interrupted, the effect of interruption on the flow rate/average velocity $V_{aa}$ associated with the heated air 94 will be less than the effect of interruption on the flow rate/average velocity $V_{ap}$ of paper product 32. As a result, the air 94 will continuously come in contact with and flow past the paper product 32 which lags behind as the air 94 proceeds at a faster rate. This process (which also involves other uncharacterized physical phenomena) enables the paper product 32 to be completely dried. Complete drying of the paper product 32 can be achieved if $V_{aa}$ is at least about 5% greater than $V_{ap}$. In a preferred embodiment, the $V_{ap}$ value for any given piece of paper associated with the paper product 32 will be about 50–65 ft./sec., with the $V_{aa}$ value for any given air molecule within the stream of air 94 being about 70–80 ft./sec. as both of these materials flow through the chamber 88 (e.g. along a helical path).

As previously noted, many different methods may be used to periodically interrupt the flow of paper product 32 through the chamber 88. However, a preferred system for accomplishing this goal is illustrated in FIGS. 2–3. With reference to these figures, the drying chamber 88 will include a plurality of elongate, movable, and equally sized baffle members 170 therein which are designed to periodically interrupt the flow of paper product 32 and air 94 through the interior region 120 of the chamber 88. While the present invention shall not be limited regarding the manner in which the baffle members 170 are positioned and/or moved (e.g. rotated) within the chamber 88, a preferred embodiment involves the use of a rotor unit 174 having the baffle members 170 attached thereto. As shown in FIG. 2, the rotor unit 174 includes an elongate cylindrical member 178 having a first end 182 and a second end 186. Secured to the first end 182 of the cylindrical member 178 at the center thereof is a first outwardly-extending rod member 194. Attached to the second end 186 of the cylindrical member 178 at the center thereof is a second outwardly-extending rod member 202. The rotor unit 174 has a central longitudinal axis $X_2$ illustrated in FIG. 2. While the length $L_2$ of the cylindrical member 178 (FIG. 2) is preferably less than the length $L_1$ of the drying chamber 88, the overall length $L_3$ of the rotor unit 174 (FIG. 2) is greater than the length $L_1$ of the drying chamber 88. In addition, the diameter $D_3$ of the cylindrical member 178 is less than the internal diameter $D_2$ of the chamber 88 as shown in FIG. 2. The rotor unit 174 is preferably manufactured from the same materials used to construct the drying chamber 88 as listed above.

Secured to the exterior surface 206 of the cylindrical member 178 are multiple rows 208 of baffle members 170. The present invention shall not be limited to any particular number of baffle members 170 or rows 208, with these parameters being determined by preliminary experimental tests. In a preferred embodiment, four linear rows 208 of baffle members 170 will be employed, with all of the rows 208 being circumferentially spaced at equal intervals on the exterior surface 206 of the cylindrical member 178. This arrangement of baffle members 170 is used in the embodiment of FIG. 2, although only three of the four rows 208 are visible. Each row 208 in the embodiment of FIG. 2 begins at the first end 182 of the cylindrical member 178 and terminates at the second end 186. Furthermore, the maximum diameter $D_4$ of the rotor unit 174 (which includes the height of baffle members 170) is still less than the internal diameter $D_2$ of the chamber 88. This design allows the placement and free rotation of the rotor unit 174 within the interior region 120 of the chamber 88 (discussed below).

Regarding the baffle members 170, each baffle member 170 preferably involves a plate structure 210 of flat, planar design which is attached by mechanical fasteners (e.g. screws, bolts, and the like) to a connecting rod 214. In turn, the connecting rod 214 is attached by welding, mechanical fasteners, or the like to the exterior surface 206 of the cylindrical member 178. Within each row 208, the baffle members 170 are preferably spaced at equal intervals along the rotor unit 174. In a preferred embodiment, the baffle members 170 are produced from a strong and inert plastic (e.g. high density polyethylene), with the connecting rods 214 being constructed from stainless steel. To achieve optimum results and proper deflection of the paper product 32 within the chamber 88, each of the baffle members 170 (e.g. plate structures 210) is preferably positioned in a slanted, non-parallel orientation relative to the longitudinal axis $X_2$ of the rotor unit 174. Specifically, each baffle member 170 (e.g. plate structure 210) is angled (tilted) outwardly at an angle $A_2$ shown in FIG. 2 of about 4°–45° (optimum=30°). However, the present invention shall not be limited to these numerical values which will vary based on a variety of factors including the selected flow pattern associated with the stream of heated air 94, the direction in which the heated air 94 is flowing, the size of the system 10, and other considerations. Regardless of which angular configuration is used, it is preferred that all of the baffle members 170 on the rotor unit 174 be oriented in a similar manner.

As previously indicated, the rotor unit 174 is positioned within the drying chamber 88 to form an integrated drying system generally indicated at reference number 211 in FIGS. 1–3. To assemble the drying system 211, a first end plate 212 is secured to the first end 98 of the chamber 88 by welding and the like. Attachment of the end plate 212 as described above effectively closes the first end 98 of the chamber 88. As illustrated in FIGS. 2–3, the first end plate 212 further includes an opening 214 therethrough. The opening 214 has a diameter which is larger than the diameter of the first rod member 194 of the rotor unit 174. As a result, the first rod member 194 is rotatably received within and extends outwardly from the opening 214 when the drying system 211 is assembled. Likewise, the second end 102 of the chamber 88 includes a second end plate 218 secured thereto by welding and the like. Attachment of the end plate 218 as described above effectively closes the second end 102 of the chamber 88. The second end plate 218 further includes an opening 222 therethrough. The opening 222 in the second end plate 218 has a diameter which is larger than the diameter of the second rod member 202 of the rotor unit 174. As a result, the second rod member 202 is rotatably received within and extends outwardly from the opening 222 when the drying system 211 is assembled.

In an assembled configuration, the rotor unit 174 will be centered within the drying chamber 88 so that the longitudinal axis $X_1$ of drying chamber 88 is in precise axial alignment with the longitudinal axis $X_2$ of the rotor unit 174. The rotor unit 174 can freely rotate within the interior region 120 of the drying chamber 88 since the maximum diameter $D_4$ of the rotor unit 174 (FIG. 2) is less than the internal diameter $D_2$ of the chamber 88. Accordingly, the baffle members 170 will not come in contact with and/or scrape the interior surface 116 of the side wall 110 within the drying chamber 88. In a preferred embodiment, each of the baffle members 170 inside the chamber 88 will be separated from the interior surface 116 of the side wall 110 by a distance of about 0.5–2.0 in.

Finally, as schematically illustrated in FIG. 1, at least one of the first and second rod members 194, 202 associated with the rotor unit 174 (which extend outwardly from the drying chamber 88) is operatively connected to a conventional electric motor unit 226. In FIG. 1, the motor unit 226 is attached to the second rod member 202. In this manner, the rotor unit 174 and attached baffle members 170 may be moved (e.g. rotated) within the drying chamber 88.

Specific dimensions associated with an exemplary and preferred drying chamber 88 have been described above. Regarding a preferred rotor unit 174 suitable for use with the exemplary drying chamber 88, the rotor unit 174 will have an overall length $L_3$ of about 7–9 ft., with a maximum diameter $D_4$ (FIG. 2) of about 4.5–5.5 ft. As previously indicated, four rows 208 of baffle members 170 will be used which are equally spaced at 90° intervals around the exterior surface 206 of the cylindrical member 178. Each row 208 will include about 12–24 rectangular, plate-like baffle members 170 which are spaced at equal intervals along the rotor unit 174. Each baffle member 170 will be about 6–12 in. tall and about 2–4 in. wide. Finally, each baffle member 170 will be positioned at an angle $A_2$ of about 30°. Again, these values are provided for example purposes, with the present invention not being limited to the foregoing parameters.

As previously stated, the present invention shall not be limited to any particular drying apparatus or components which are used to periodically interrupt movement of the paper product 32 and air 94. Components other than those illustrated in FIGS. 1–3 may be employed. For example, it may be possible to employ a system which includes a plurality of upwardly-extending post-like structures (not shown) which are circular in cross-section instead of the plate-like baffle members 170 illustrated in FIG. 2. The selected baffle members (regardless of configuration) may alternatively be secured to the inside of a rotatable sleeve-like structure (not shown) which is inserted (e.g. nested) within the drying chamber 88 and thereafter rotated so that the air 94 and paper product 32 pass therethrough. Furthermore, the system 10 may be configured so that the baffle members within the drying chamber 88 remain stationary and do not move during system operation, although moving baffle members provide best results. Accordingly, the present invention may employ numerous systems to achieve periodic interruption of the paper product 32 as described above.

In the embodiment of FIGS. 1–3, the rotor unit 174 and attached baffle members 170 are continuously moved (e.g. rotated) within the drying chamber 88 using the motor unit 226. Movement (rotation) of the baffle members 170 specifically occurs during passage of the paper product 32 and heated air 94 through the chamber 88. As a result, the flow path of the paper product 32 and air 94 is temporarily interrupted at least once and, in most cases, multiple times. Using this approach, the paper product 32 will experience a sufficient amount of dwell (delay) time in the chamber 88 to become completely dry. Likewise, as indicated above, both the stream of heated air 94 and paper product 32 will be interrupted by the moving baffle members 170. However, the air 94 will "recover" and accelerate more quickly after interruption than the paper product 32 due to the minimal weight and density of air 94. In this manner, the paper product 32 will move slower through the chamber 88, thereby allowing greater flow contact between the paper product 32 and air 94. In the system 10 as shown in FIGS. 1–3, the rotor unit 174 may be rotated in either a clockwise or counterclockwise direction, provided that it rotates in the same direction as the air 94 (which preferably flows in a helical pathway as described above). Preferred rotational speeds to be used in connection with the rotor unit 174 will be about 3–30 rpm.

After passage of the paper product 32 through the drying chamber 88, it exits the chamber 88 via outlet port 126 (FIG. 1). Within the chamber 88, drying of the paper product 32 produces a dried fire-resistant cellulose insulation product 250 which is collected from the chamber 88 as indicated above. The insulation product 250 may then be further processed as desired to create a final product with specific size characteristics. In this regard, the present invention shall not be limited to any additional procedures which are undertaken after production of the insulation product 250 to achieve size alteration. Typical post-production steps are shown in FIG. 1. With reference to system 10, the insulation product 250 is transferred into a first hammermill unit 254 using a second air transport system 260 positioned between the drying chamber 88 and the first hammermill unit 254. In a preferred embodiment, the second air transport system 260 will include a conduit 264 having a first end 268 which is operatively connected to the outlet port 126 of the drying chamber 88 and a second end 272 connected to the first hammermill unit 254. Positioned in-line within the conduit 264 between the first end 268 and the second end 272 is a motor driven fan unit 276. The fan unit 276 is oriented so that it draws the insulation product 250 through the conduit 264, directly through the fan unit 276 (which is sized to accommodate passage of the insulation product 250), and into the first hammermill unit 254. In a preferred embodiment, the fan unit 276 is designed to operate at a speed of about 1500–1800 rpm so that sufficient suction forces are generated within the conduit 264. Air-driven transport systems of this type are known in the art for material transfer, and are commercially available from the same source indicated above in connection with the first air transport system 34.

The first hammermill unit 254 is designed to further reduce the size of the individual pieces of paper associated with the insulation product 250. The first hammermill unit 254 will generate a size-reduced insulation product 280 in which each piece of paper in the product 280 has a length of about 0.25–1.0 in. and a width of about 0.25–1.0 in. Hammermill systems (including the first hammermill unit 254) are generally known in the art for material processing. An exemplary hammermill system suitable for use as the first hammermill unit 254 is produced by Jacobsen Machine Works of Minneapolis, Minn. (U.S.A.)—model number 24×42.

After leaving the first hammermill unit 254, the size-reduced insulation product 280 is transferred into a second hammermill unit 284 using a third air transport system 288 positioned between the first hammermill unit 254 and the second hammermill unit 284. The second hammermill unit 284 will be of the same general type, configuration, and structure as the first hammermill unit 254. Likewise, the commercial hammermill system described above in connection with the first hammermill unit 254 may be used as the second hammermill unit 284. In a preferred embodiment, the third air transport system 288 will involve the same components, features, and operating characteristics as the second air transport system 260. Specifically, the third air transport system 288 will include a conduit 290 having a first end 292 connected to the first hammermill unit 254 and a second end 294 connected to the second hammermill unit 284. Positioned in-line within the conduit 290 between the first end 292 and the second end 294 is a motor driven fan unit 296. The fan unit 296 is oriented so that it draws the size-reduced insulation product 280 through the conduit 290, directly through the fan unit 296 (which is sized to accommodate passage of the insulation product 280), and into the second hammermill unit 284. In a preferred embodiment, the fan unit 296 is designed to operate at a speed of about 1500–1800 rpm so that sufficient suction forces are generated within the conduit 290.

The second hammermill unit 284 is designed to further reduce the size of the individual pieces of paper associated with the insulation product 280. The second hammermill unit 284 generates a completed insulation product 300 in which each piece of paper in the product 300 has a length of about 0.01–0.2 in. and a width of about 0.01–0.2 in. The completed insulation product 300 is then collected and packaged as desired (e.g. in a plurality of bags or other containment units).

The present invention involves an all-liquid system which avoids the disadvantages associated with powder-type systems. These disadvantages are listed above. In contrast, the claimed process provides numerous advantages not attainable by powder-based systems. For example, one advantage involves the substantial elimination of dust problems and the safety considerations associated therewith. Regarding dust generation, the claimed system typically generates only about 10% of the dust produced in powder-type systems. Other advantages include (1) simplification of the entire processing system by reducing the amount of required equipment and labor; (2) a reduction in the amount and complexity of processing equipment needed to manufacture the insulation product; (3) a substantial reduction in chemical (e.g. fire retardant) use; and (4) a corresponding reduction in material costs due to decreased chemical use. Furthermore, the completed insulation product produced in accordance with the invention meets all applicable government requirements for fire resistance including those stated in ASTM C-739. The completed product also has a lower bulk density (typically about 1.2–1.8 lb./ft$^2$) compared with materials produced using powdered fire retardants (normally up to about 2.4 lb./ft$^2$). The term "bulk density" and the desirability of insulation products having a low bulk density are discussed above. In addition, the completed insulation product is characterized by a substantial absence of fine fibrous residue which (if present) can reduce the fire/heat resistance of the product. However, fiber materials within the insulation product are more rigid compared with conventionally-prepared materials. This characteristic results in less settling of the product when used in building structures. Additional benefits provided by the insulation product are indicated above.

Having herein described preferred embodiments of the invention, it is anticipated that suitable modifications can be made thereto by individuals skilled in the art which would nonetheless remain within the scope of the invention. For example, the invention shall not be specifically limited to the numerical parameters and specific hardware associated with the drying chamber, as well as other system components described above. Accordingly, the present invention shall only be construed in connection with the following claims:

The invention that is claimed is:

1. A method for producing a fire-resistant cellulose insulation product comprising the steps of:

providing a supply of individual pieces of paper and a paper drying chamber;

applying at least one liquid fire retardant composition to said pieces of paper, said liquid fire retardant composition soaking into said pieces of paper to produce a fire retardant-soaked paper product;

passing a stream of heated air through said drying chamber;

passing said fire retardant-soaked paper product through said drying chamber in combination with said stream of heated air, said stream of heated air moving said paper product through said drying chamber;

interrupting said passing of said fire retardant-soaked paper product through said drying chamber at least once during movement of said paper product and said heated air through said drying chamber in order to cause a delay in said passing of said paper product through said chamber, said delay allowing said heated air to completely dry said paper product to produce a dried, fire-resistant cellulose insulation product within said drying chamber; and collecting said fire-resistant cellulose insulation product from said drying chamber.

2. The method of claim 1 wherein said heated air has a temperature of about 300°–350° F.

3. The method of claim 1 wherein said applying of said liquid fire retardant composition to said pieces of paper comprises delivering said liquid fire retardant composition to said pieces of paper in a mist comprising a plurality of individual droplets each having a diameter of about 40–200 microns.

4. The method of claim 1 wherein said liquid fire retardant composition comprises a solution of at least one fire retardant compound selected from the group consisting of ammonium sulfate, monoammonium phosphate, diammonium phosphate, boric acid, aluminum sulfate, sodium tetraborate, ferrous sulfate, zinc sulfate, and mixtures thereof.

5. The method of claim 1 wherein each of said individual pieces of paper is comprised of grade 8 newspaper.

6. A method for producing a fire-resistant cellulose insulation product comprising the steps of:

providing a supply of individual pieces of paper and a paper drying chamber;

applying at least one liquid fire retardant composition to said pieces of paper, said liquid fire retardant composition soaking into said pieces of paper to produce a fire retardant-soaked paper product;

passing a stream of heated air through said drying chamber;

passing said fire retardant-soaked paper product through said drying chamber in combination with said stream of heated air about 45–120 seconds after said applying of said liquid fire retardant composition to said pieces of paper, said stream of heated air moving said paper product through said drying chamber;

interrupting said passing of said fire retardant-soaked paper product through said drying chamber at least once during movement of said paper product and said heated air through said drying chamber in order to cause a delay in said passing of said paper product through said chamber, said delay allowing said heated air to completely dry said paper product to produce a dried, fire-resistant cellulose insulation product within said drying chamber; and collecting said fire-resistant cellulose insulation product from said drying chamber.

7. The method of claim 6 wherein said heated air has a temperature of about 300°–350° F.

8. The method of claim 6 wherein said applying of said liquid fire retardant composition to said pieces of paper comprises delivering said liquid fire retardant composition to said pieces of paper in a mist comprising a plurality of individual droplets each having a diameter of about 40–200 microns.

9. The method of claim 6 wherein said liquid fire retardant composition comprises a solution of at least one fire retardant compound selected from the group consisting of ammonium sulfate, monoammonium phosphate, diammonium phosphate, boric acid, aluminum sulfate, sodium tetraborate, ferrous sulfate, zinc sulfate, and mixtures thereof.

10. The method of claim 6 wherein each of said individual pieces of paper is comprised of grade 8 newspaper.

11. A method for producing a fire-resistant cellulose insulation product comprising the steps of:

providing a supply of individual pieces of paper and a paper drying chamber comprising a longitudinal axis therethrough;

applying at least one liquid fire retardant composition to said pieces of paper, said liquid fire retardant composition soaking into said pieces of paper to produce a fire retardant-soaked paper product;

delivering a stream of heated air into said drying chamber at an angle relative to said longitudinal axis of said drying chamber, said stream of heated air thereafter passing through said drying chamber;

passing said fire retardant-soaked paper product through said drying chamber in combination with said stream of heated air, said stream of heated air moving said paper product through said drying chamber;

interrupting said passing of said fire retardant-soaked paper product through said drying chamber at least once during movement of said paper product and said heated air through said drying chamber in order to cause a delay in said passing of said paper product through said chamber, said delay allowing said heated air to completely dry said paper product to produce a dried, fire-resistant cellulose insulation product within said drying chamber; and collecting said fire-resistant cellulose insulation product from said drying chamber.

12. The method of claim 11 wherein said angle is about 90°.

13. A method for producing a fire-resistant cellulose insulation product comprising the steps of:

providing a supply of individual pieces of paper, each of said pieces of paper being comprised of grade 8 newspaper;

providing a paper drying chamber comprising a longitudinal axis therethrough;

applying at least one liquid fire retardant composition to said pieces of paper, said liquid fire retardant composition comprising a solution of at least one fire retardant compound selected from the group consisting of ammonium sulfate, monoammonium phosphate, diammonium phosphate, boric acid, aluminum sulfate, sodium tetraborate, ferrous sulfate, zinc sulfate, and mixtures thereof, said liquid fire retardant composition soaking into said pieces of paper to produce a fire retardant-soaked paper product, said applying of said liquid fire retardant composition to said pieces of paper comprising delivering said liquid fire retardant composition to said pieces of paper in a mist comprising a plurality of individual droplets each having a diameter of about 40–200 microns;

delivering a stream of heated air into said drying chamber at an angle of about 90° relative to said longitudinal axis of said drying chamber, said stream of heated air thereafter passing through said drying chamber, said heated air having a temperature of about 300°–350° F.;

passing said fire retardant-soaked paper product through said drying chamber in combination with said stream of heated air about 45–120 seconds after said applying of said liquid fire retardant composition to said pieces of paper, said stream of heated air moving said paper product through said drying chamber;

interrupting said passing of said fire retardant-soaked paper product through said drying chamber at least once during movement of said paper product and said heated air through said drying chamber in order to cause a delay in said passing of said paper product through said chamber, said delay allowing said heated air to completely dry said paper product to produce a dried, fire-resistant cellulose insulation product within said drying chamber; and collecting said fire-resistant cellulose insulation product from said drying chamber.

14. A method for producing a fire-resistant cellulose insulation product comprising the steps of:

providing a supply of individual pieces of paper and a paper drying chamber comprising a plurality of baffle members therein;

applying at least one liquid fire retardant composition to said pieces of paper, said liquid fire retardant composition soaking into said pieces of paper to produce a fire retardant-soaked paper product;

passing a stream of heated air through said drying chamber;

passing said fire retardant-soaked paper product through said drying chamber in combination with said stream of heated air, said stream of heated air transporting said paper product through said drying chamber, said paper product coming in contact with at least one of said baffle members within said drying chamber in order to interrupt said transporting of said paper product through said drying chamber and cause a delay in said passing of said paper product therethrough, said delay allowing said heated air to completely dry said paper product to produce a dried, fire-resistant cellulose insulation product within said drying chamber; and collecting said fire-resistant cellulose insulation product from said drying chamber.

15. The method of claim 14 wherein said heated air has a temperature of about 300°–350° F.

16. The method of claim 14 wherein said applying of said liquid fire retardant composition to said pieces of paper comprises delivering said liquid fire retardant composition to said pieces of paper in a mist comprising a plurality of individual droplets each having a diameter of about 40–200 microns.

17. The method of claim 14 wherein said liquid fire retardant composition comprises a solution of at least one fire retardant compound selected from the group consisting of ammonium sulfate, monoammonium phosphate, diammonium phosphate, boric acid, aluminum sulfate, sodium tetraborate, ferrous sulfate, zinc sulfate, and mixtures thereof.

18. The method of claim 14 wherein each of said individual pieces of paper is comprised of grade 8 newspaper.

19. A method for producing a fire-resistant cellulose insulation product comprising the steps of:

providing a supply of individual pieces of paper and a paper drying chamber comprising a plurality of movable baffle members therein;

applying at least one liquid fire retardant composition to said pieces of paper, said liquid fire retardant composition soaking into said pieces of paper to produce a fire retardant-soaked paper product;

passing a stream of heated air through said drying chamber;

moving each of said baffle members within said drying chamber during said passing of said stream of heated air through said drying chamber;

passing said fire retardant-soaked paper product through said drying chamber in combination with said stream of heated air, said stream of heated air transporting said paper product through said drying chamber, said paper product coming in contact with at least one of said baffle members during said moving of said baffle members within said drying chamber in order to interrupt said transporting of said paper product through said drying chamber and cause a delay in said passing of said paper product therethrough, said delay allowing said heated air to completely dry said paper product to produce a dried, fire-resistant cellulose insulation product within said drying chamber; and collecting said fire-resistant cellulose insulation product from said drying chamber.

20. The method of claim 19 wherein said heated air has a temperature of about 300°–350° F.

21. The method of claim 19 wherein said applying of said liquid fire retardant composition to said pieces of paper comprises delivering said liquid fire retardant composition to said pieces of paper in a mist comprising a plurality of individual droplets each having a diameter of about 40–200 microns.

22. The method of claim 19 wherein said liquid fire retardant composition comprises a solution of at least one fire retardant compound selected from the group consisting of ammonium sulfate, monoammonium phosphate, diammonium phosphate, boric acid, aluminum sulfate, sodium tetraborate, ferrous sulfate, zinc sulfate, and mixtures thereof.

23. The method of claim 19 wherein each of said individual pieces of paper is comprised of grade 8 newspaper.

24. A method for producing a fire-resistant cellulose insulation product comprising the steps of:

providing a supply of individual pieces of paper and a paper drying chamber comprising a longitudinal axis and a plurality of movable baffle members therein;

applying at least one liquid fire retardant composition to said pieces of paper, said liquid fire retardant composition soaking into said pieces of paper to produce a fire retardant-soaked paper product;

delivering a stream of heated air into said drying chamber at an angle relative to said longitudinal axis of said drying chamber, said stream of heated air thereafter passing through said drying chamber;

moving each of said baffle members within said drying chamber during said delivering of said stream of heated air into said drying chamber;

passing said fire retardant-soaked paper product through said drying chamber in combination with said stream of heated air, said stream of heated air transporting said paper product through said drying chamber, said paper product coming in contact with at least one of said baffle members during said moving of said baffle members within said drying chamber in order to interrupt said transporting of said paper product through said drying chamber and cause a delay in said passing of said paper product therethrough, said delay allowing said heated air to completely dry said paper product to produce a dried, fire-resistant cellulose insulation product within said drying chamber; and collecting said fire-resistant cellulose insulation product from said drying chamber.

25. The method of claim 24 wherein said angle is about 90°.

26. A method for producing a fire-resistant cellulose insulation product comprising the steps of:

providing a supply of individual pieces of paper and a paper drying chamber comprising a plurality of movable baffle members therein;

applying at least one liquid fire retardant composition to said pieces of paper, said liquid fire retardant composition soaking into said pieces of paper to produce a fire retardant-soaked paper product;

passing a stream of heated air through said drying chamber;

moving each of said baffle members within said drying chamber during said delivering of said stream of heated air into said drying chamber;

passing said fire retardant-soaked paper product through said drying chamber in combination with said stream of heated air about 45–120 seconds after said applying of said liquid fire retardant composition to said pieces of paper, said stream of heated air transporting said paper product through said drying chamber, said paper product coming in contact with at least one of said baffle members during said moving of said baffle members within said drying chamber in order to interrupt said transporting of said paper product through said drying chamber and cause a delay in said passing of said paper product therethrough, said delay allowing said heated air to completely dry said paper product to produce a dried, fire-resistant cellulose insulation product within said drying chamber; and collecting said fire-resistant cellulose insulation product from said drying chamber.

27. The method of claim 26 wherein said heated air has a temperature of about 300°–350° F.

28. The method of claim 26 wherein said applying of said liquid fire retardant composition to said pieces of paper comprises delivering said liquid fire retardant composition to said pieces of paper in a mist comprising a plurality of individual droplets each having a diameter of about 40–200 microns.

29. A method for producing a fire-resistant cellulose insulation product comprising the steps of:

providing a supply of individual pieces of paper, each of said pieces of paper being comprised of grade 8 newspaper;

providing a paper drying chamber comprising a longitudinal axis and a plurality of movable baffle members therein;

applying at least one liquid fire retardant composition to said pieces of paper, said liquid fire retardant composition comprising a solution of at least one fire retardant compound selected from the group consisting of ammonium sulfate, monoammonium phosphate, diammonium phosphate, boric acid, aluminum sulfate, sodium tetraborate, ferrous sulfate, zinc sulfate, and mixtures thereof, said liquid fire-retardant composition soaking into said pieces of paper to produce a fire retardant-soaked paper product, said applying of said liquid fire retardant composition to said pieces of paper comprising delivering said liquid fire retardant composition to said pieces of paper in a mist comprising a plurality of individual droplets each having a diameter of about 40–200 microns;

delivering a stream of heated air into said drying chamber at an angle of about 90° relative to said longitudinal axis of said drying chamber, said stream of heated air thereafter passing through said drying chamber;

moving each of said baffle members within said drying chamber during said delivering of said stream of heated air into said drying chamber;

passing said fire retardant-soaked paper product through said drying chamber in combination with said stream of heated air about 45–120 seconds after said applying of said liquid fire retardant composition to said pieces of paper, said stream of heated air transporting said paper product through said drying chamber, said paper product coming in contact with at least one of said baffle members during said moving of said baffle members within said drying chamber in order to interrupt said transporting of said paper product through said drying chamber and cause a delay in said passing of said paper product therethrough, said delay allowing said heated air to completely dry said paper product to produce a dried, fire-resistant cellulose insulation product within said drying chamber; and collecting said fire-resistant cellulose insulation product from said drying chamber.

* * * * *